US011346184B2

(12) United States Patent
Escudero et al.

(10) Patent No.: US 11,346,184 B2
(45) Date of Patent: May 31, 2022

(54) DELAYED DROP ASSEMBLY

(71) Applicant: Schlumberger Technology Corporation, Sugar Land, TX (US)

(72) Inventors: Jose Escudero, Pearland, TX (US); Andrew Prisbell, Rosharon, TX (US); Bhagyashri Walse, Pune (IN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 234 days.

(21) Appl. No.: 16/050,179

(22) Filed: Jul. 31, 2018

(65) Prior Publication Data

US 2020/0040704 A1 Feb. 6, 2020

(51) Int. Cl.

| | |
|---|---|
| ***E21B 43/117*** | (2006.01) |
| ***E21B 37/00*** | (2006.01) |
| ***E21B 34/06*** | (2006.01) |
| ***E21B 23/01*** | (2006.01) |

(52) U.S. Cl.

CPC ..... *E21B 37/00* (2013.01); *E21B 23/01* (2013.01); *E21B 34/06* (2013.01); *E21B 43/117* (2013.01)

(58) Field of Classification Search

CPC ..... E21B 37/00; E21B 23/01; E21B 34/06; E21B 43/117

See application file for complete search history.

(56) References Cited

U.S. PATENT DOCUMENTS

| | | | | |
|---|---|---|---|---|
| 2,029,478 A | | 2/1936 | Haines | |
| 2,139,104 A | | 12/1938 | Wells | |
| 2,446,640 A | | 8/1948 | Davis | |
| 3,118,501 A | | 1/1964 | Kenley | |
| 3,163,112 A | | 12/1964 | Rhea | |
| 3,311,178 A | | 3/1967 | Mcelheny | |
| 3,589,442 A | | 6/1971 | Kilgore | |
| 3,630,282 A | | 12/1971 | Lanmon | |
| 3,709,294 A | | 1/1973 | Kilgore | |
| 3,760,878 A | | 9/1973 | Peevey | |
| 4,122,899 A | * | 10/1978 | Brieger | E21B 23/01 102/319 |
| 4,161,985 A | | 7/1979 | Fournier et al. | |

(Continued)

FOREIGN PATENT DOCUMENTS

| | | |
|---|---|---|
| EP | 0155128 A2 | 9/1985 |
| EP | 0415770 A2 | 3/1991 |

(Continued)

OTHER PUBLICATIONS

Reeves, et al, An Exploration 3D Seismic Field Test Program in Osage County, Oklahoma, Jan. 1999, National Petroleum Technology Office, U.S. Department of Energy, Tulsa, Oklahoma, SPE 2648 (86 pages).

(Continued)

*Primary Examiner* — Yong-Suk (Philip) Ro

(74) *Attorney, Agent, or Firm* — Rodney Warfford

(57) ABSTRACT

A method of perforating a wellbore is described herein. The method includes lowering a perforating wellbore tool into the wellbore proximate a formation to be perforated, anchoring the perforating wellbore tool by setting an anchoring tool, perforating the formation, creating a low pressure chamber in the perforating wellbore tool, and unsetting the anchoring tool after a time delay.

20 Claims, 9 Drawing Sheets

(56) References Cited

U.S. PATENT DOCUMENTS

| | | | | |
|---|---|---|---|---|
| 4,175,042 | A | 11/1979 | Mondshine | |
| 4,372,384 | A | 2/1983 | Kinney | |
| 4,484,632 | A | 11/1984 | Vann | |
| 4,501,331 | A | 2/1985 | Brieger | |
| 4,515,217 | A | 5/1985 | Stout | |
| 4,526,233 | A | 7/1985 | Stout | |
| 4,557,331 | A | 12/1985 | Stout | |
| 4,564,076 | A | 1/1986 | Vann et al. | |
| 4,576,233 | A | 3/1986 | George | |
| 4,605,074 | A | 8/1986 | Barfield | |
| 4,616,701 | A | 10/1986 | Stout et al. | |
| 4,619,325 | A | 10/1986 | Zunkel | |
| 4,619,333 | A | 10/1986 | George | |
| 4,621,692 | A | 11/1986 | Mondshine | |
| 4,629,001 | A | 12/1986 | Miller et al. | |
| 4,650,010 | A | 3/1987 | George et al. | |
| 4,800,958 | A | 1/1989 | Haugen et al. | |
| 4,804,044 | A | 2/1989 | Wesson et al. | |
| 4,805,726 | A | 2/1989 | Taylor et al. | |
| 4,862,964 | A | 9/1989 | George et al. | |
| 4,865,131 | A | 9/1989 | Moore et al. | |
| 4,903,775 | A | 2/1990 | Manke | |
| 5,044,388 | A | 9/1991 | Barton et al. | |
| 5,088,557 | A | 2/1992 | Ricles et al. | |
| 5,103,912 | A | 4/1992 | Flint | |
| 5,117,911 | A | 6/1992 | Navarette et al. | |
| 5,131,472 | A | 7/1992 | Dees et al. | |
| 5,135,051 | A | 8/1992 | Facteau et al. | |
| 5,188,191 | A | 2/1993 | Tomek | |
| 5,228,508 | A | 7/1993 | Facteau et al. | |
| 5,287,741 | A * | 2/1994 | Schultz | E21B 49/088 166/250.17 |
| 5,301,755 | A | 4/1994 | George et al. | |
| 5,318,126 | A | 6/1994 | Edwards et al. | |
| 5,355,802 | A | 10/1994 | Petitjean | |
| 5,366,013 | A | 11/1994 | Edwards et al. | |
| 5,445,078 | A | 8/1995 | Marion | |
| 5,551,344 | A | 9/1996 | Couet et al. | |
| 5,609,178 | A | 3/1997 | Hennig et al. | |
| 5,635,636 | A | 6/1997 | Alexander | |
| 5,680,905 | A | 10/1997 | Green et al. | |
| 5,836,393 | A | 11/1998 | Johnson | |
| 5,837,925 | A | 11/1998 | Nice | |
| 5,845,712 | A * | 12/1998 | Griffith, Jr. | E21B 43/116 166/278 |
| 5,865,254 | A | 2/1999 | Huber et al. | |
| 6,102,126 | A | 8/2000 | Huber et al. | |
| 6,152,232 | A | 11/2000 | Webb et al. | |
| 6,173,783 | B1 | 1/2001 | Abbott-Brown et al. | |
| 6,206,100 | B1 | 3/2001 | George et al. | |
| 6,220,355 | B1 | 4/2001 | French | |
| 6,302,209 | B1 | 10/2001 | Thompson, Sr. et al. | |
| 6,315,043 | B1 * | 11/2001 | Farrant | E21B 23/01 166/297 |
| 6,336,408 | B1 | 1/2002 | Parrott et al. | |
| 6,336,506 | B2 | 1/2002 | Wesson | |
| 6,343,658 | B2 | 2/2002 | Webb | |
| 6,347,673 | B1 | 2/2002 | Dailey | |
| 6,394,184 | B2 | 5/2002 | Tolman et al. | |
| 6,412,614 | B1 | 7/2002 | Lagrange et al. | |
| 6,481,494 | B1 | 11/2002 | Dusterhoft et al. | |
| 6,494,260 | B2 | 12/2002 | van Petegem et al. | |
| 6,497,284 | B2 | 12/2002 | van Petegem et al. | |
| 6,527,050 | B1 | 3/2003 | Sask | |
| 6,588,508 | B2 | 7/2003 | Parrott et al. | |
| 6,598,682 | B2 | 7/2003 | Johnson et al. | |
| 6,604,818 | B2 | 8/2003 | Leibman et al. | |
| 6,732,798 | B2 | 5/2004 | Johnson et al. | |
| 6,865,792 | B2 | 3/2005 | Kash | |
| 7,121,340 | B2 | 10/2006 | Grove et al. | |
| 7,182,138 | B2 | 2/2007 | Behrmann et al. | |
| 9,194,219 | B1 * | 11/2015 | Hardesty | F42D 1/055 |
| 2002/0020535 | A1 | 2/2002 | Johnson et al. | |
| 2002/0053434 | A1 * | 5/2002 | Chen | E21B 47/12 166/297 |
| 2002/0153142 | A1 | 10/2002 | Eslinger et al. | |
| 2003/0062160 | A1 | 4/2003 | Boney et al. | |
| 2003/0089498 | A1 | 5/2003 | Johnson et al. | |
| 2004/0168805 | A1 | 9/2004 | Fripp et al. | |
| 2005/0167108 | A1 * | 8/2005 | Chang | F42B 3/02 166/298 |
| 2012/0018157 | A1 * | 1/2012 | Gill | F42C 9/10 166/297 |
| 2012/0298361 | A1 * | 11/2012 | Sampson | E21B 23/01 166/297 |
| 2016/0319646 | A1 * | 11/2016 | Escudero | E21B 43/117 |
| 2018/0216446 | A1 * | 8/2018 | Allison | E21B 43/26 |

FOREIGN PATENT DOCUMENTS

| | | | |
|---|---|---|---|
| EP | 0488875 | A2 | 6/1992 |
| EP | 1041244 | A2 | 10/2000 |
| EP | 1223303 | A1 | 7/2002 |
| GB | 677824 | A | 8/1952 |
| GB | 686530 | A | 1/1953 |
| GB | 2065750 | A | 7/1981 |
| GB | 2242009 | A | 9/1991 |
| RU | 1771508 | A1 | 10/1992 |
| RU | 1831561 | A1 | 7/1993 |
| RU | 1736223 | A1 | 11/1995 |
| RU | 2054525 | C1 | 2/1996 |
| RU | 1570384 | A1 | 5/1996 |
| RU | 2075593 | C1 | 3/1997 |
| RU | 2084616 | C1 | 7/1997 |
| RU | 2085719 | C1 | 7/1997 |
| RU | 2120028 | C1 | 10/1998 |
| RU | 2123577 | C1 | 12/1998 |
| RU | 2146759 | C1 | 3/2000 |
| RU | 2162934 | C2 | 2/2001 |
| RU | 2168621 | C2 | 6/2001 |
| RU | 2171367 | C2 | 7/2001 |
| RU | 2179235 | C1 | 2/2002 |
| RU | 2179629 | C1 | 2/2002 |
| RU | 2180938 | C2 | 3/2002 |
| RU | 2183259 | C2 | 6/2002 |
| SU | 926252 | A1 | 5/1982 |
| WO | 9733069 | A2 | 9/1997 |
| WO | 9942696 | A1 | 8/1999 |
| WO | 0107860 | A2 | 2/2001 |
| WO | 0125595 | A1 | 4/2001 |
| WO | 0165060 | A1 | 9/2001 |

OTHER PUBLICATIONS

G. E. King, et al, A Field Study of Underbalance Pressures Necessary to Obtain Clean Perforations Using Tubing Conveyed Perforating, SPE 14321, Jun. 1986, Journal of Petroleum Technology (3 pages).

Regalbuto, John A., et al, Underbalanced Perforation Characteristics as Affected by Differential Pressure, SPE 15816, Feb. 1988, SPE Production Engineering (6 pages).

Halleck, P.M., et al, Effects of Underbalance on Perforation Flow, May 1989, SPE 16895, SPE Production Engineering (4 pages).

Crawford, H.R., Underbalanced Perforating Design, 1969, SPE 19749, Society of Petroleum Engineers (14 pages).

L.A. Behrmann et al., Measurement of Additional Skin Resulting From Perforation Damage, SPE 22809, Oct. 1991, Society of Petroleum Engineers (12 pages).

Pucknell et al., An Investigation of the Damaged Zone Created by Perforating, SPE 22811, Oct. 1991, Society of Petroleum Engineers (12 pages).

Behrmann et al., Effects of Underbalance and Effective Stress on Perforation Damage in Weak Sandstone: Initial Results; SPE 24770, Oct. 1992, Society of Petroleum Engineers (10 pages).

Scott et al., Air Foam Improves Efficiency of Completion and Workover Operations in Low-Pressure Gas Wells; SPE 27922, Dec. 1995, Society of Petroleum Engineers (7 pages).

L.A. Behrmann, Underbalance Criteria for Minimum Perforation Damage; SPE30081, Sep. 1996, Society of Petroleum Engineers (5 pages).

(56) References Cited

OTHER PUBLICATIONS

Hovem et al., An Investigation of Critical Parameters for Optimum Perforation Clean-Up; SPE 30084, May 1995, Society of Petroleum Engineers (10 pages).
L.A. Behmann et al., Underbalance or Extreme Overbalance; SPE 31083, Feb. 1996, Society of Petroleum Engineers (18 pages).
Behrmann et al., Borehole Dynamics During Underbalanced Perforating; Jun. 1997, SPE 38139, Society of Petroleum Engineers (8 pages).
Smith et al., Improvements in Perforating Performance in High Compressive Strength Rocks; SPE 38141, Jun. 1997, Society of Petroleum Engineers (6 pages).
Swift et al., Micro-Mechanical Modeling of Perforating Shock Damage; SPE 39458, Feb. 1998, Society of Petroleum Engineers (11 pages).
Berhmann et al; "Underbalance or Extreme Overbalance"; SPE Production & Facilities, vol. 14, No. 3, Aug. 1999, pp. 187-196.
Underdown et al., Optimizing Perforating Strategy in Well Completions to Maximize Productivity; SPE 58772, Feb. 2000, Society of Petroleum Engineers (7 pages).
Venkitaraman et al., Perforating Requirements for Sand Prevention; SPE 58788, Feb. 2000, Society of Petroleum Engineers (5 pages).
Behrmann et al., Perforating Requirements for Fracture Stimulations; SPE 59480, Dec. 1999, Society of Petroleum Engineers (7 pages).
Walton et al., Laboratory Experiments Provide New Insights into Underbalanced Perforating; Oct. 2001, SPE 71642, Society of Petroleum Engineers (8 pages).
Behrmann et al., New Underbalanced Perforating Technique Increases Completion Efficiency and Eliminates Costly Acid Stimulation; SPE 77364, Oct. 2002, Society of Petroleum Engineers (15 pages).
Fridlander, L. Ya., Shooting-Explosion Equipment and Application Thereof in Wellbores, 1985, pp. 32-36 and 119-126, Nedra (Mineral Resources) Publishing House, Moscow, Russia.
Grigoryan, N.G., Development of Oil and Gas Formations by Means of Shooting Perforators, 1982, pp. 22-44 and 222-232, Nedra (Mineral Resources) Publishing House, Moscow, Russia.
Folse, K., Allin, M., Chow, C., and Hardesty, 1.; "Perforating System Selection for Optimum Well Inflow Performance"; SPE 73762 paper presented at the Internal Symposium of Formation Damage; Lafayette, LA; Feb. 20-21, 2002.
Morten Stenhaug, Leif Erichsen, Statoil; Fokko H.C. Doornbosch, Robert A. Parrott, Schlumberger: ""A Step Change in Perforating Technology Improves Productivity of Horizontal Wells in the North Sea,"" SPE 84910, Oct. 20-21, pp. 1-11.
Overview of Implo Treat Pamphlet, Implo Treat Systems, Jan. 17, 2000 (4 pages).
Sooleimanov, A.B., et al, Know-How and Equipment for Thorough Repair of Wellbores, 1987, pp. 288-297, Nedra (Mineral Resources) Publishing House, Moscow, Russia. (no Translation Availble).
Gorodissky & Partners, Transmittal Letter with Official Action received from the Patent Office of the Russian Federation, dated Mar. 14, 2006, 10 pages, Moscow, Russia.

* cited by examiner

DELAYED DROP ASSEMBLY

FIELD OF THE DISCLOSURE

The disclosure relates to the field of hydrocarbon well perforation. More specifically, devices for anchoring and delaying the release of a perforating gun are disclosed.

BACKGROUND OF THE DISCLOSURE

When a hydrocarbon well is drilled, a casing may be placed in the well to line and seal the wellbore. Cement is then pumped down the well under pressure and forced up the outside of the casing until the well column is also sealed. This casing process ensures that the well is isolated, and prevents uncontrolled migration of subsurface fluids between different well zones, and provides a conduit for installing production tubing in the well. However, to connect the inside of the casing and wellbore with the inside of the formation to allow for hydrocarbon flow from the formation to the inside of the casing, holes are formed throughout the casing and into the wellbore. This practice is commonly referred to as perforating of the casing and formation. Open-hole wells are also possible, i.e., where a casing is not used and jetting, fracturing or perforation is directly applied to the formation.

During the perforating process, a gun-assembled body containing a plurality of shaped charges is lowered into the wellbore and positioned opposite the subsurface formation to be perforated. Electrical signals are then passed from a surface location through a wireline to one or more blasting caps located in the gun body, thereby causing detonation of the blasting caps. The exploding blasting caps in turn transfer a detonating wave to a detonator cord which further causes the shaped charges to detonate. The detonated shaped charges form an energetic stream of high-pressure gases and high velocity particles, which perforates the well casing and the adjacent formation to form perforation tunnels. The hydrocarbons and/or other fluids trapped in the formation flow into the tunnels, into the casing through the orifices cut in the casing, and up the casing to the surface for recovery.

It may then be desirable to drop the perforating gun assembly after operation so that retrieval of the support equipment can be accomplished without sticking the portion of the equipment, which swells after operation.

The explosive nature of the formation of perforation tunnels shatters sand grains of the formation. A layer of "shock damaged region" having a permeability lower than that of the original formation matrix may be formed around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties, and so forth. The shock damaged region and loose debris in the perforation tunnels may impair the productivity of production wells or the injectivity of injector wells.

A common means of cleaning the perforation tunnels is to underbalance the perforation by using a lower wellbore pressure during perforation. This way, the surge flow of fluid into the wellbore during perforation should clean the perforation tunnel of some of the disaggregated rock and liner debris. However, underbalance perforating may not always be effective, and may be expensive and unsafe to implement in certain downhole conditions.

Acidizing is another widely used method for removing perforation damage. However, it is not effective for treating sand and loose debris left inside the perforation tunnel.

Thus, what is needed in the art are methods and devices to improve the cleanliness of the perforations to facilitate fluid flow. Although wellbore perforations are quite successful, even incremental improvements in technology to improve fluid communication can mean the difference between cost effective production and reservoirs that are uneconomical to produce.

SUMMARY OF THE DISCLOSURE

The present methods includes any of the following embodiments in any combination(s) of one or more thereof:

An embodiment of the present disclosure provides a method of perforating a wellbore, the method comprising the steps of: (a) lowering a perforating wellbore tool into the wellbore proximate a formation to be perforated, (b) anchoring the perforating wellbore tool by setting an anchoring tool, (c) perforating the formation, (d) creating a low pressure chamber in the perforating wellbore tool, and (e) unsetting the anchoring tool after a time delay.

Another embodiment of the present disclosure provides a wellbore tool. In this embodiment, the wellbore tool comprises a gun anchor system with one or more explosive type anchor releases. The wellbore tool further comprises a perforating gun having one or more shaped charges for forming perforation tunnels in a formation, one or more ports, and a surge chamber, wherein the one or more ports can be actuated to allow surge flow from the perforation tunnels into the surge chamber. The wellbore tool further comprises an explosive train, wherein said explosive train is connected to both a detonating cord in said perforating gun, and a ballistic time delay system connected to the explosive type anchor releases.

Yet another embodiment of the present invention provides a method of perforating a wellbore. The method comprises the step of lowering a perforating wellbore tool into the wellbore proximate a formation to be perforated, wherein said perforating wellbore tool comprises a gun anchor with one or more explosive type anchor releases, a perforating gun having a plurality of shaped charges initiated by ignition of a detonating cord, an interior chamber, and one or more communication ports that when opened are in communication with the interior chamber, a ballistic time delay system initiated by ignition of a fuse to release the one or more explosive type anchor releases, and an explosive train split into two paths, a first path for igniting the detonating cord of the perforating gun, and a second path for igniting the fuse of the ballistic time delay system. The method further comprises the steps of anchoring said perforating wellbore tool, activating the explosive train to ignite the plurality of shaped charges to perforate the formation and ignite the fuse of the ballistic time delay, and opening the one or more communication ports to create a low pressure in the interior chamber.

This summary is provided to introduce a selection of concepts that are further described below in the detailed description. However, many modifications are possible without materially departing from the teachings of this disclosure. Accordingly, such modifications are intended to be included within the scope of this disclosure as defined in the claims. This summary is not intended to identify key or essential features of the claimed subject matter, nor is it intended to be used as an aid in limited the scope of the claimed subject matter.

BRIEF DESCRIPTION OF THE DRAWINGS

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and.

DESCRIPTION OF EMBODIMENTS OF THE DISCLOSURE

Figure 1:
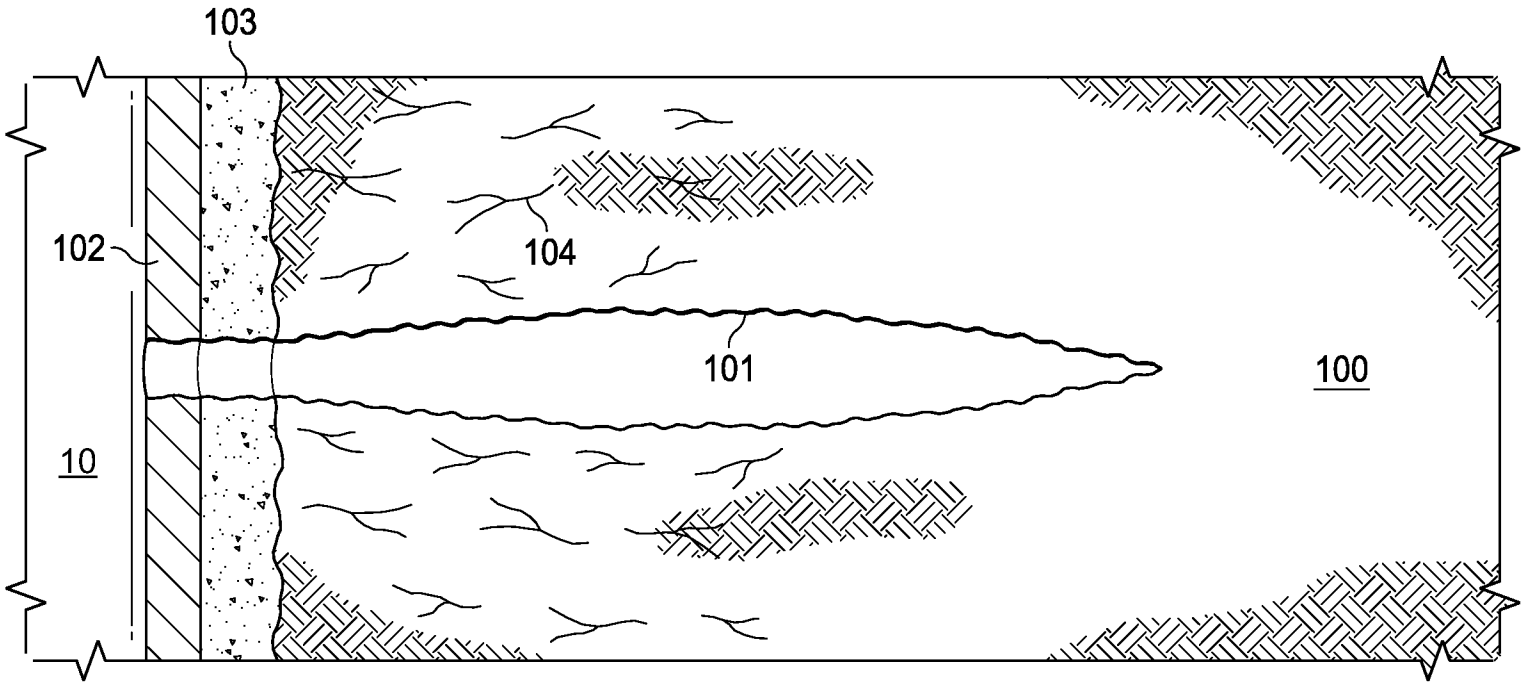
FIG. 1 depicts a typical perforation tunnel formed by an explosive shaped charge.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Generally, the present disclosure provides a wellbore perforation tool that has a delayed drop post-perforation. The wellbore perforation tool of the present disclosure controls the downhole transient underbalance pressure during and after perforation while anchoring a tool string, delaying the release of the anchoring device, and dropping a perforating gun string to the bottom of the well after perforation. This allows for the creation of clean perforations in the reservoir, which reduces time and costs associated with perforation cleanup.

FIG. 1 displays a typical perforation tunnel 101 in a reservoir 100 created by an explosive shaped charge (not shown) detonated from within the well 10. In cased hole completions, a casing 102 (or a liner) lines the well 10 and an outer layer of cement 103 seals the well column. The final stage of the completion involves running in perforating guns with shaped charges down to the desired depth, and firing the charges to perforate the casing 102 (or liner). In some applications, immediately after firing, the perforating tools are dropped to the bottom of the well 10 to allow for other completion activities.

If large volumes of cement filtrate invade the rock during perforation, the possibility of formation damage 104 exists. Further, the perforation process may also generate a tunnel full of rock debris mixed in with the perforator charge debris. Such outcomes reduce the productivity and injectivity of the perforation and well 10.

Applicant previously developed a technology to create cleaner perforations for better performing wells. This technology, described in U.S. Pat. No. 6,598,682, which is incorporated herein in its entirety for all purposes, modifies a conventional perforating gun to control the underbalance effect experienced during perforations.

Figure 2A:
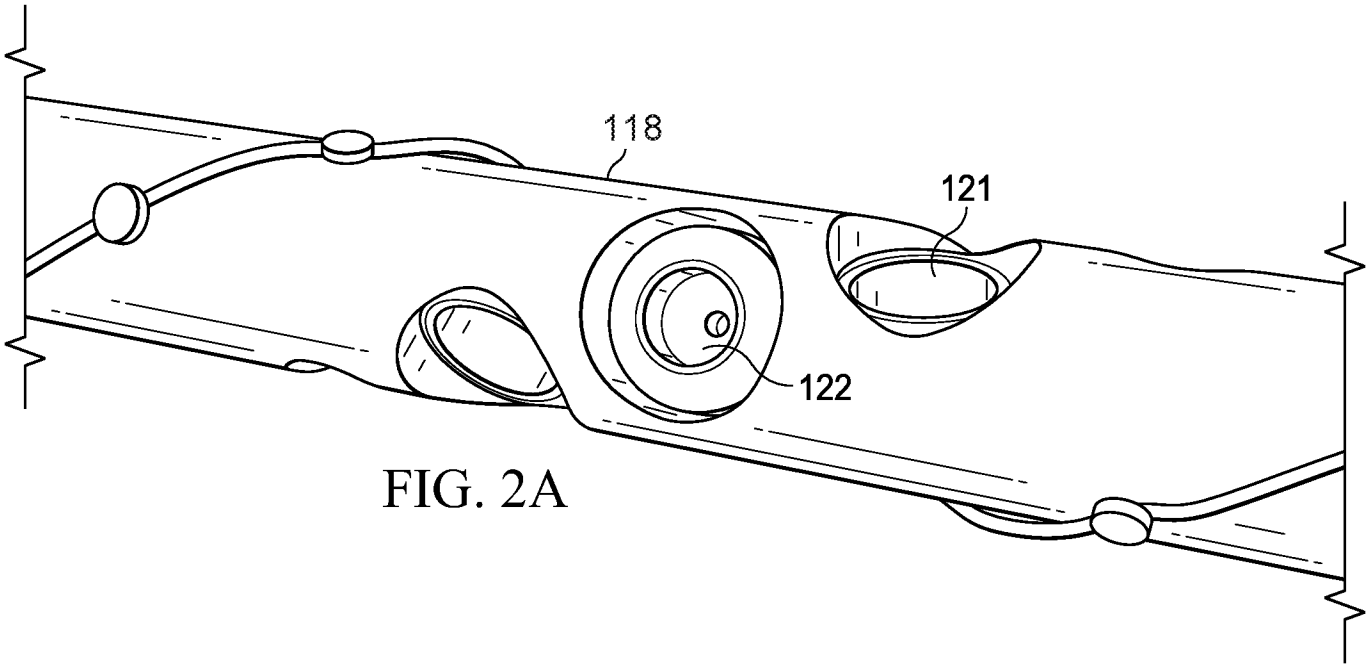
FIG. 2A displays a modified loading tube loaded with underbalanced perforating charges alongside conventional shaped charges.
Figure 2B:
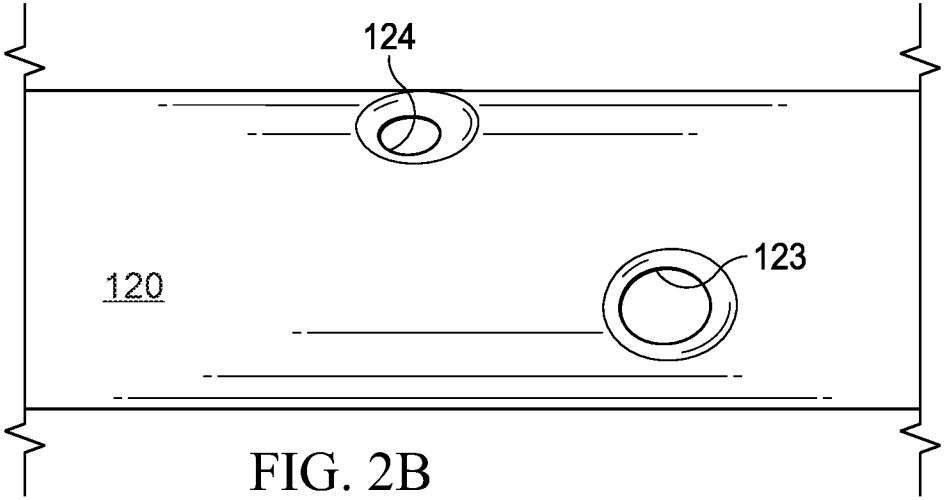
FIG. 2B illustrates a perforating gun after the underbalanced perforating charges and the conventional shaped charges have been detonated.

FIG. 2A shows a modified loading tube 118 that can be utilized in embodiments of the present disclosure. As shown, the modified loading tube 118 is loaded with an underbalanced perforating charge 122 alongside a conventional shaped charge 121. FIG. 2B shows the perforating gun 120 after the charges (121 and 122) have been detonated. As shown in FIG. 2B, the exit hole 123 for the underbalanced perforating charge 122 is much larger than the exit hole 124 of the conventional shaped charge 121. The underbalanced perforating charge 122 only penetrates the exterior wall of the perforating gun 120 to affect the pressure in the wellbore. It does not, however, penetrate the casing and/or formation or affect the formation pressure. In use, the underbalance perforating charges 122 are detonated slightly before the conventional shaped charges 121 to ensure that the pressure wave travels along the perforating gun 120.

It should be understood that in alternate embodiments of the present disclosure, depending on the application for creating the underbalance condition, the underbalance perforating charges 122 may be installed in either a gun alongside conventional charged 121 or in a perforating gun 120 alongside underbalance perforating charges only.

Figure 3:
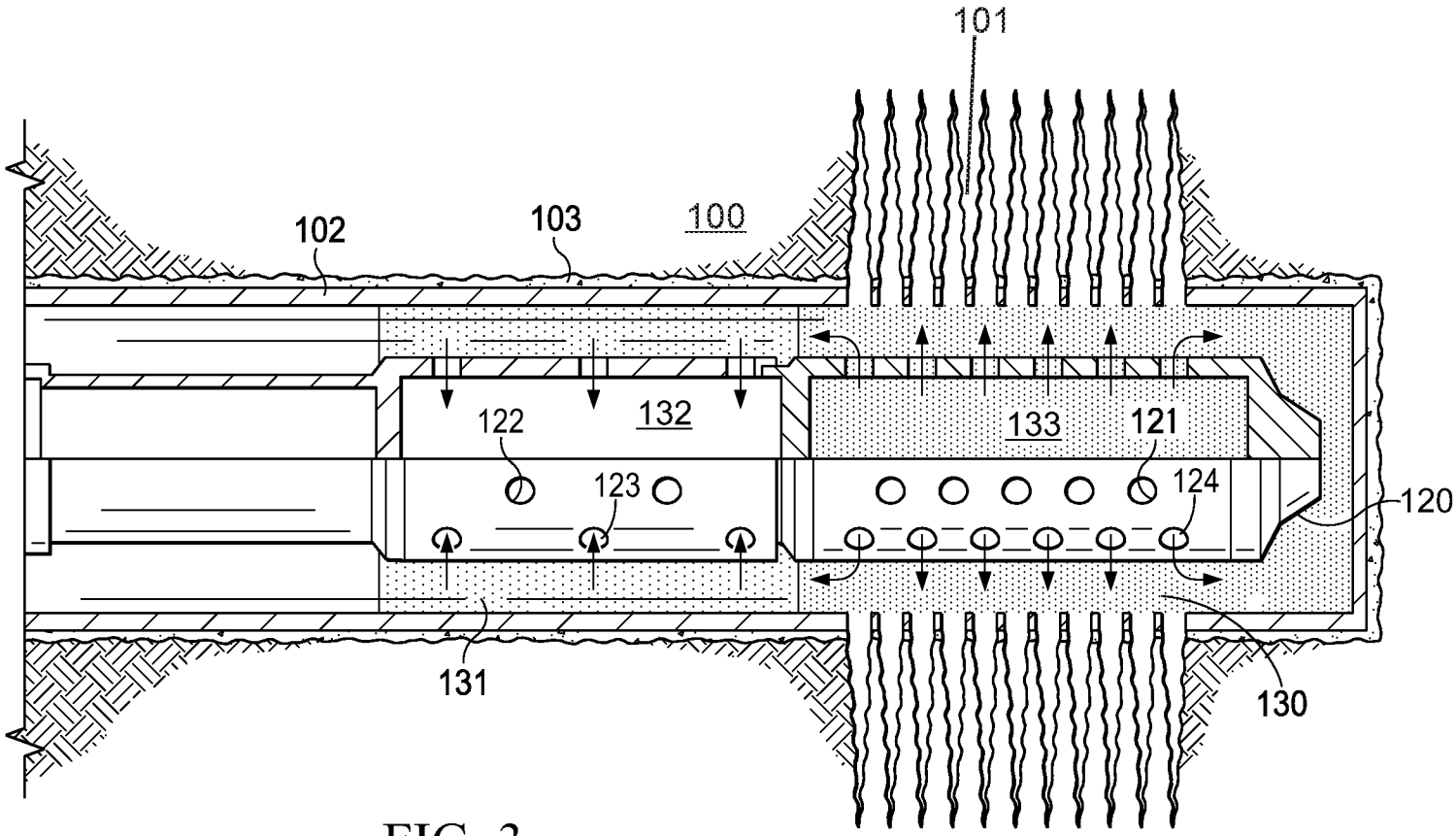
FIG. 3 illustrates a modified perforating gun having multiple chambers, including a surge chamber.

An embodiment of a modified perforating gun 120 that can be used in embodiments of the present disclosure is depicted in FIG. 3, the modified perforating gun 120 has two chambers. The first chamber 133 containing the conventional charges for creating perforation tunnels 101 in the formation 100, and the second chamber 132 that acts as a surge chamber for formation fluids.

In the embodiment shown, the underbalanced perforating charges 122 create an opening 123 in the second (surge) chamber 132 of the perforating gun 120, but not the casing 102 or formation 100. Unlike conventional perforating systems that rely on a large static pressure differential between the wellbore and the formation 100 to remove perforation debris and crushed-zone damage, the underbalanced perforating system fully exploits the transient underbalance that occurs immediately after perforating. This creates a large dynamic underbalance that results in flow into (shown by the arrows in FIG. 3) the gun's surge chamber 132 and thus collection of the perforation debris and formation fluids in the surge chamber 132 while minimizing skin and crushed zone damage to the perforation tunnels 101. In other words, there is a fast increase in pressure above the ambient value in the perforation zone 130 and a fast decrease in pressure below the ambient value in the area 131 adjacent to the surge chamber 132. This results in a debris-free path for flow from the reservoir to the wellbore.

In the embodiment of the perforating gun 120 shown in FIG. 3, the communication ports (exit holes) 123 in the surge chamber 132 are opened by detonation of underbalanced perforating charges 122. However, it should be understood that in alternate embodiments of the perforating gun 120 and thus present disclosure, the surge chamber 132 communication ports 123 may be selectively openable by use of a valve or some other mechanism such that maintains the communication ports 123 in a closed position during deployment and anchoring of the perforating gun 120, opening only when perforation services are occurring. For instance, the communication ports 123 may be opened by a valve controlled from surface by wireless, electric, optical, or other signals or known communication methods.

Underbalanced perforating technology is not easily combinable with automatic release anchoring technology. Typically, when using anchoring tools with automatic release, the perforating guns are automatically released and dropped to the bottom of the well at the instant of the detonation. This timing does not allow for the underbalance effect to be fully captured. As such, the perforation tunnels may not be fully cleaned, resulting in decreased production performance.

To overcome this pressure issue and inability to create the full underbalance effect, the delayed drop assembly of the present disclosure combines an anchoring device having an explosive type release mechanism with a ballistic delay fuse. Traditionally, ballistic delay fuses have been used to delay the detonation for individual perforating guns. In embodiments of the present disclosure, however, ballistic delay fuses are being used to delay the release and drop of perforating guns. This allows for the surge chamber to fill with fluid and create the dynamic underbalance needed to clean the perforations before it drops to the bottom of the well.

Figure 4A:
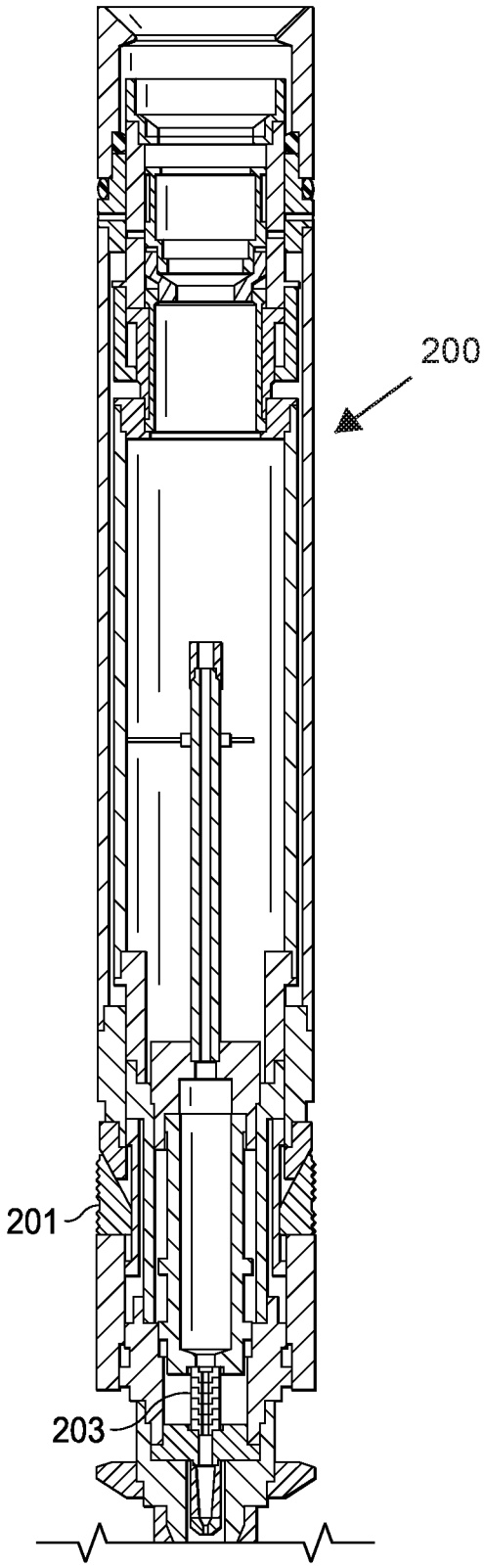
FIG. 4A illustrates an exemplary tool string anchoring system shown in the running-in position.
Figure 4B:
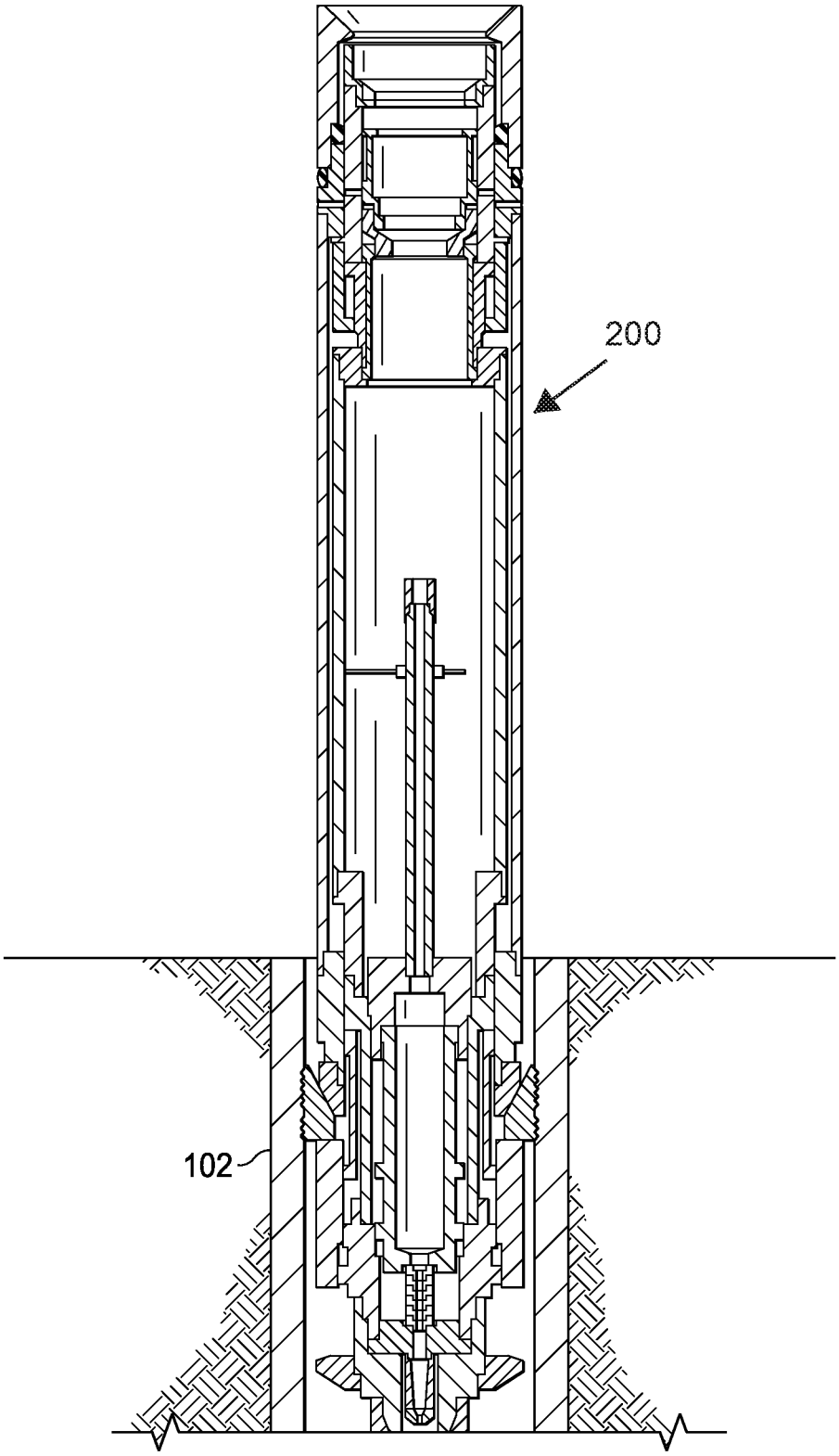
FIG. 4B illustrates an exemplary tool string anchoring system shown in the set position.
Figure 4C:
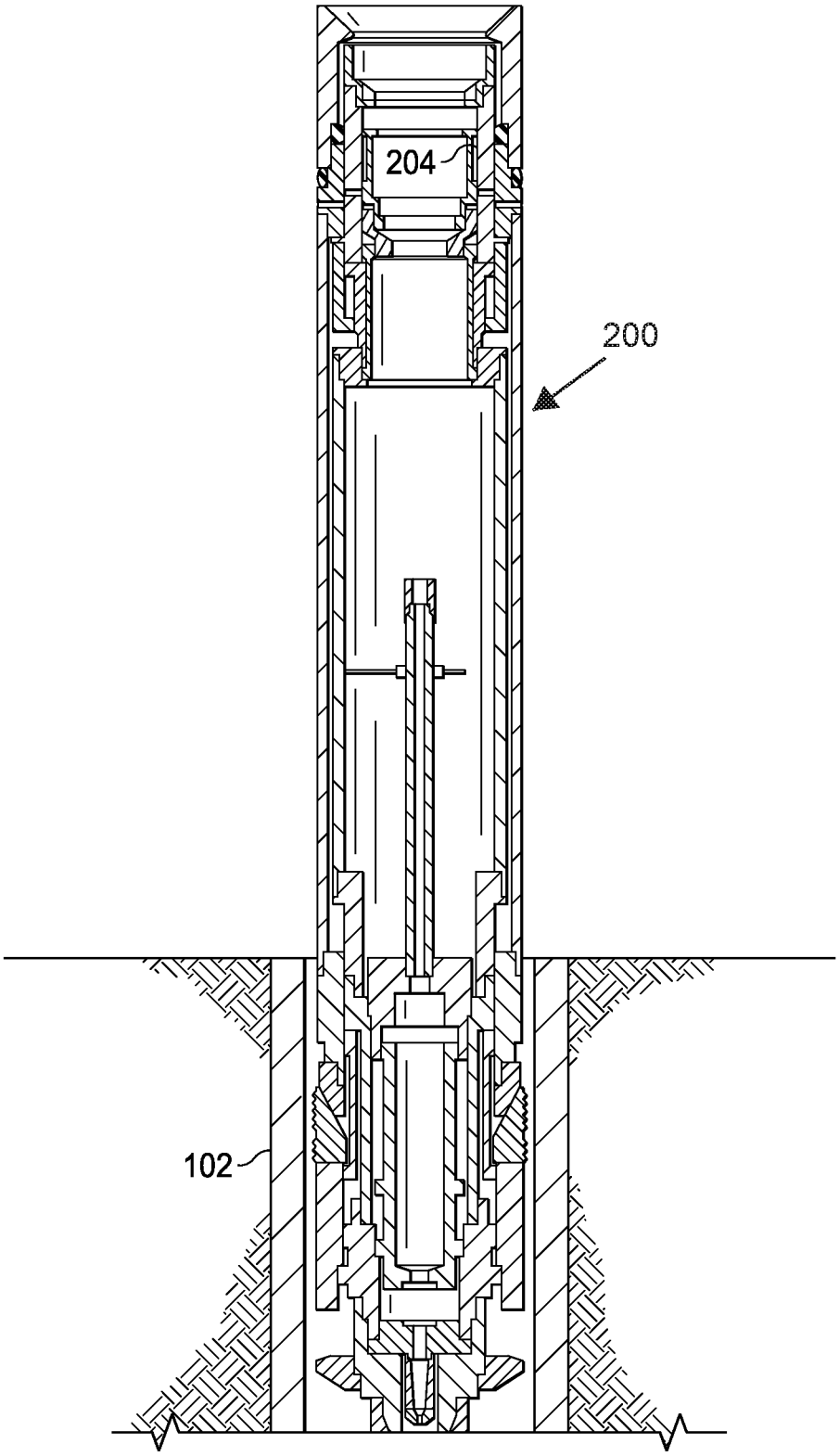
FIG. 4C illustrates an exemplary tool string anchoring system shown in the automatic release position.

FIGS. 4A-4C displays an exemplary tool string anchoring system, referred to generally as 200, that can be used with embodiments of the delayed drop assembly of the present disclosure. It should be understood that any anchoring tool that utilizes an explosive type release mechanism can be used by embodiments of the delayed drop assembly of the present disclosure. The exemplary anchoring tool 200 is illustrated in the running-in position (FIG. 4A), the set position (FIG. 4B), and the automatic release position (FIG. 4C). The anchoring tool 200 has anchor slips 201 at the downhole end that catch on the casing wall 102. The anchoring tool 200 uses an explosive type release mechanism that is activated immediately prior to detonating the shaped charges. The detonation generates a force that retracts the slips 201 and initiates the drop of the entire tool string to the bottom of the well by breaking the break plug 203. The exemplary anchoring tool 200 illustrated in FIGS. 4A-4C additionally has an emergency mechanical backup release 204 that allows the guns to be dropped manually or brought back to the surface without being detonated.

Figure 5:
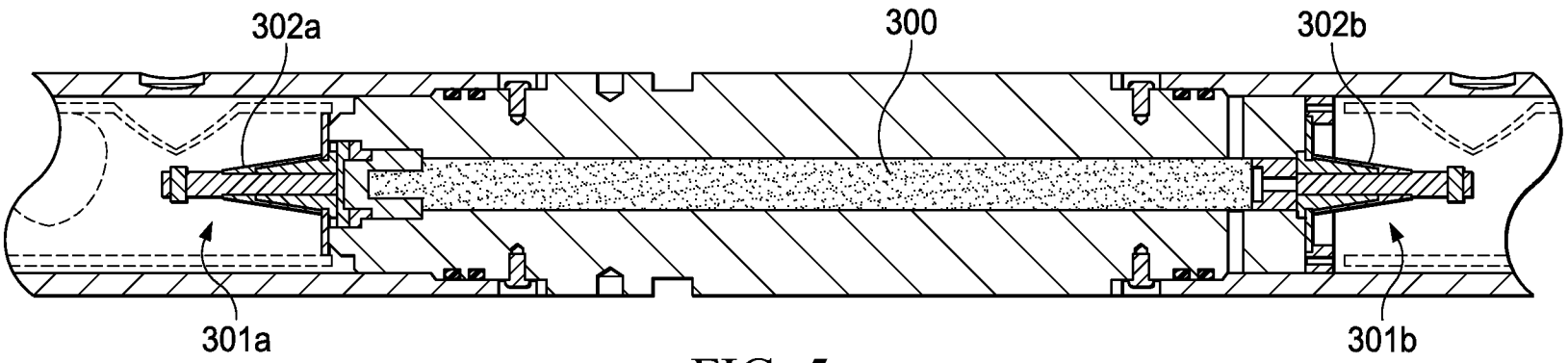
FIG. 5 depicts a ballistic delay fuse explosive (BTDF) as it is conventionally used between perforating guns.

As noted above, and as illustrated in FIG. 5, a ballistic delay fuse 300 is frequently used between perforating guns to delay the detonation of adjacent perforating guns (301*a* and 301*b*). Such design is show in FIG. 5 with single adaptive ballistic transfers 302*a*/302*b* communicating with each respective perforating gun 301*a*/301*b*. As discussed in further detail below, embodiments of the present disclosure add a delay fuse 300 to the anchor system, which allows for a delay in the release of the anchors and sufficient time to obtain a complete underbalance effect.

Figure 6A:
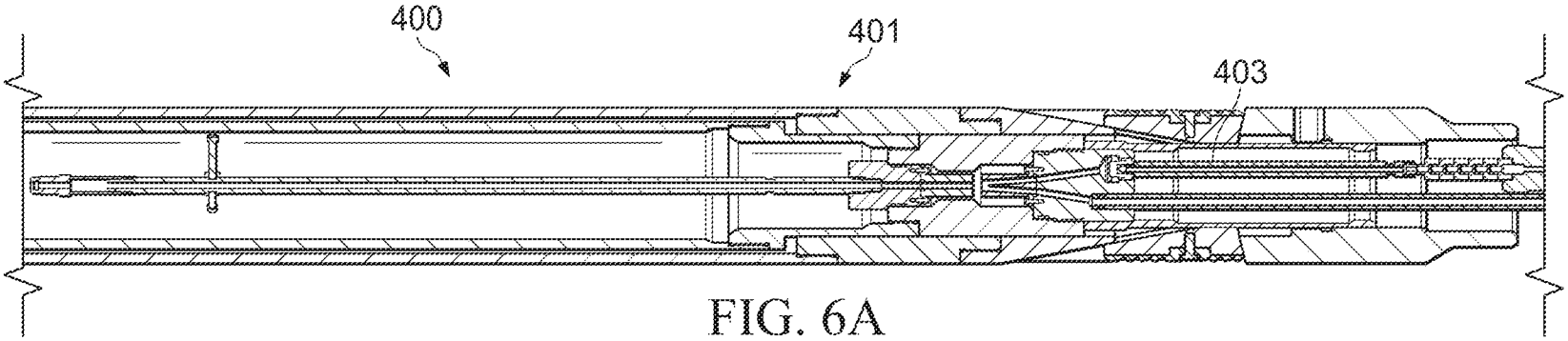
FIG. 6A illustrates an embodiment of the delayed drop assembly of the present disclosure.
Figure 6B:
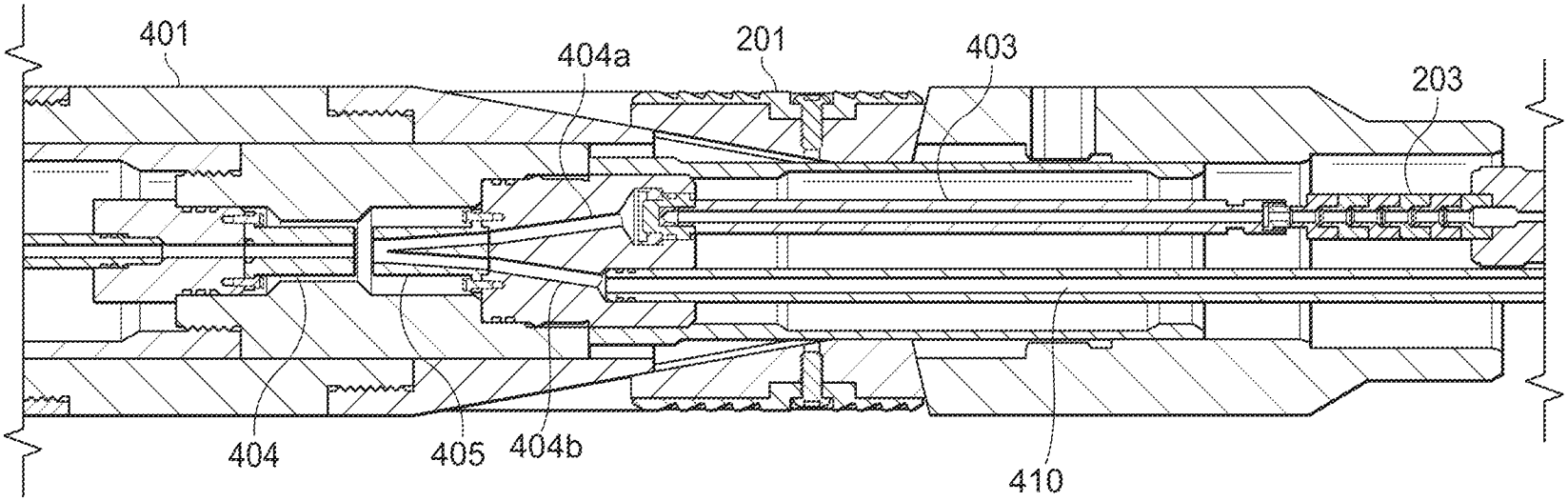
FIG. 6B provides a more detailed description of the delayed drop assembly of FIG. 6A.

An overview of an embodiment of the delayed drop assembly 400 of the present disclosure is shown in FIG. 6A and a more detailed view is shown in FIG. 6B. The ballistic time delay 403 is incorporated directly into the anchoring tool 401. The explosive train 404 is split at the explosive transfer system 405 into two (2) paths. One path 404*b* leads to, and is capable of igniting, the detonating cord 410 leading down to the perforating gun (not shown) and the underbalanced perforating charges. The other path 404*a* leads to, and is capable of igniting, the fuse of the ballistic time delay system 403. In the embodiment shown, the path 404*b* leading to the detonating cord 410 is not delayed, thus the perforating gun fires immediately.

The ballistic time delay system 403, however, has a ballistic time delay fuse (BTDF) that will delay the release of the anchor slips 201 on the anchoring tool 401. This, in turn, delays the dropping of the perforating gun post-perforation such that there is sufficient time for the underbalance effect to be obtained and for fluids and debris to flow in the communication ports 123 of the surge chamber 132. The BTDF explosive path will then continue to a break plug 203 and follow typical anchoring tool release mechanisms to release the slips 201 anchoring the tool 401. This will cause the anchoring tool 401 and perforating guns below to fall to the bottom of the well. Because of the delayed drop, the perforations in the wellbore will be cleaned by the dynamic underbalance pressure created by the opening of the communication ports 123 of the surge chamber 132.

Figure 7:
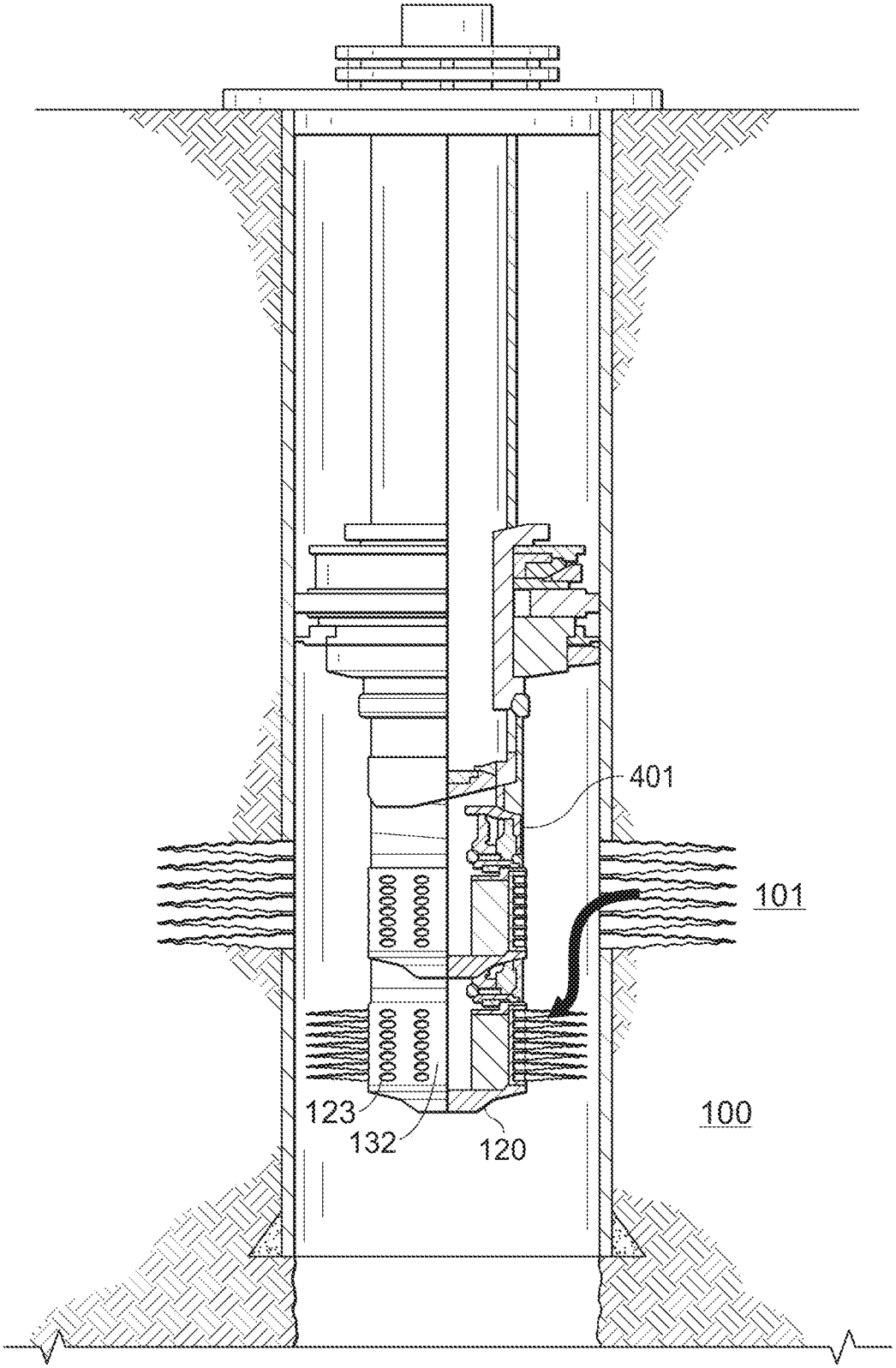
FIG. 7 illustrates an embodiment of the delayed drop assembly of the present disclosure.

FIG. 7 illustrates an embodiment of the delayed drop assembly of the present disclosure in the wellbore, with an outside and inside view of the assembly. In the embodiment shown, the anchoring tool 401 anchors the tool string by setting slips above the zone of the reservoir 100 to be perforated. Once the tool string is anchored, the explosive train is initiated. Through use of the explosive transfer system described herein, the explosive path is split into two paths. One path initiates detonation of the conventional shaped charges and the underbalanced perforating charges of the perforating gun 120 to form perforations 101 in the reservoir 100 and to open the communication ports 123 of the surge chamber 132. An underbalance state is created in which there is a rapid decrease in pressure in the area immediate the surge chamber 132 coupled with a rapid increase of pressure in the area immediate the perforated zone. This results in a flow path 420 that cleans the perforation tunnels 101 and deposits debris into the surge chamber 132. The other path initiates the ballistic time delay system that delays release of the anchors of the anchoring tool 401, which allows sufficient time for the underbalance effect to be obtained and for fluids and debris to flow in the ports 123 of the surge chamber 132 prior to release or otherwise movement of the tool string.

Embodiments of the present disclosure combine anchoring technology, underbalance perforation technology, and ballistic delay systems in to a single tool to clean perforations as they are made. The delay drop assembly tool reduces the cost and time needed for perforating services while improving the wellbore's productivity and injectivity by removing debris to minimize or eliminate crushed zone damage.

In embodiments of the present disclosure, minimal or no initial static underbalance is required. Fluctuations in the wellbore pressure immediately after shaped charge detonation actually governs the perforation cleanup. The underbalance technology utilizes this understanding of dynamic wellbore pressure to control surge flow. Further, embodiments of the present disclosure enhance acidizing and hydraulic fracturing treatments. Near wellbore washes with acid may be eliminated in most perforation operations. Additionally, remedial perforation was acid jobs may be eliminated.

Embodiments of the present disclosure improve isolation resulting from minimal cement sandface hydraulic bond disruption. Additionally, embodiments of the present disclosure reduce rig time and equipment costs associated with perforation washes, acid stimulation, pumping nitrogen and reservoir cleanup.

Although a few embodiments of the disclosure have been described in detail above, those of ordinary skill in the art will readily appreciate that many modifications are possible without materially departing from the teachings of this disclosure. For instance, it should be understood that the perforating shaped charges and the underbalance charges may be located alongside each other, with the surge chamber resulting along the interior of the perforating gun. Further, it should be understood that the present disclosure in not limited to a single perforating gun. In alternate embodiments, multiple perforating guns may be deployed and detonated in succession through use of the same explosive train.

Such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

The invention claimed is:

1. A method of perforating a wellbore, comprising:

lowering a perforating wellbore tool into the wellbore proximate a formation to be perforated;

anchoring the perforating wellbore tool by setting an anchoring tool;

perforating the formation;

creating a low pressure chamber in the perforating wellbore tool; and releasing the perforating wellbore tool by unsetting the anchoring tool after a time delay after perforating the formation.

2. The method of claim 1, wherein the low pressure chamber is created by opening ports in the perforating wellbore tool.

3. The method of claim 2, wherein the ports are opened by detonation of underbalance charges in the perforating wellbore tool.

4. The method of claim 2, wherein the ports are opened by actuation of valves in the perforating wellbore tool.

5. The method of claim 1, wherein an underbalance state results from creating the low pressure chamber.

6. The method of claim 5, wherein the underbalance state results in a flow surge from the perforated formation to the low pressure chamber.

7. The method of claim 1, wherein a ballistic delay fuse in the perforating wellbore tool provides the time delay for unsetting the anchoring tool.

8. The method of claim 1, wherein the unsetting the anchoring tool is delayed until the perforations in the formation are cleaned.

9. A wellbore tool comprising:

a gun anchor system with one or more explosive type anchor releases;

a perforating gun having one or more shaped charges for forming perforation tunnels in a formation, one or more ports, and a surge chamber, wherein the one or more ports can be actuated to allow surge flow from the perforation tunnels into the surge chamber;

an explosive train, wherein said explosive train is connected to both a detonating cord in said perforating gun, and a ballistic time delay system connected to the explosive type anchor releases.

10. The wellbore tool of claim 9, wherein the one or more ports are actuated by detonation of underbalance charges.

11. The wellbore tool of claim 9, wherein the one or more ports are actuated by a valve.

12. The wellbore tool of claim 9, wherein actuation of the one or more ports creates an underbalance condition in the wellbore.

13. The wellbore tool of claim 12, wherein the underbalance condition results in the flow surge from the perforation tunnels in the formation.

14. The wellbore tool of claim 9, wherein said ballistic time delay system utilizes a ballistic delay fuse.

15. The wellbore tool of claim 9, wherein said ballistic time delay system delays the release of the gun anchor system until after detonation of its shaped charges.

16. The wellbore tool of claim 15, wherein said ballistic time delay system delays the release of the gun anchor system until after surge flow from the perforation tunnels enters the surge chamber.

17. The wellbore tool of claim 9, comprising multiple perforating guns.

18. A method of perforating a wellbore, comprising:

lowering a perforating wellbore tool into the wellbore proximate a formation to be perforated, wherein said perforating wellbore tool comprises:

a gun anchor with one or more explosive type anchor releases;

a perforating gun having a plurality of shaped charges initiated by ignition of a detonating cord, an interior chamber, and one or more communication ports that when opened are in communication with the interior chamber; and a ballistic time delay system initiated by ignition of a fuse to release the one or more explosive type anchor releases; and an explosive train split into two paths, a first path for igniting the detonating cord of the perforating gun, and a second path for igniting the fuse of the ballistic time delay system;

anchoring said perforating wellbore tool;

activating the explosive train to ignite the plurality of shaped charges to perforate the formation and ignite the fuse of the ballistic time delay; and opening the one or more communication ports to create a flow surge from the perforated formation to the interior chamber.

19. The method of claim 18, further comprising the step of releasing the anchoring of the tool after the flow surge enters the interior chamber.

20. The method of claim 19, wherein releasing the anchoring of the tool drops the perforating gun into the wellbore.

* * * * *